US005654611A

United States Patent [19]

Yamamoto et al.

[11] Patent Number: 5,654,611

[45] Date of Patent: Aug. 5, 1997

[54] LAMP CONTROL CIRCUIT HAVING A V-I CONVERTER WITH SLOPES OF DIFFERENT MAGNITUDES AND A SECOND RESISTOR CONNECTED IN SERIES WITH A FIRST SUCH THAT THE SECOND SENSES THE OUTPUT CURRENT OF THE V-I CONVERTER

[75] Inventors: Noboru Yamamoto, Kariya; Masamichi Ishikawa, Hekinan; Kenji Yoneima, Oobu, all of Japan

[73] Assignee: Nippondenso Co., Ltd., Kariya, Japan

[21] Appl. No.: 568,564

[22] Filed: Dec. 7, 1995

[30] Foreign Application Priority Data

Dec. 7, 1994 [JP] Japan ..... 6-303771

[51] Int. Cl.[6] ..... H05B 37/02

[52] U.S. Cl. ..... 315/308; 315/DIG. 7; 315/224; 315/219

[58] Field of Search ..... 315/308, 291, 315/307, DIG. 7, 247, 224, 219

[56] References Cited

U.S. PATENT DOCUMENTS 5,481,163 1/1996 Nakamura et al. ..... 315/308

FOREIGN PATENT DOCUMENTS 5-144577 6/1993 Japan .

*Primary Examiner*—Robert Pascal
*Assistant Examiner*—Michael Shingleton
*Attorney, Agent, or Firm*—Cushman, Darby & Cushman IP Group of Pillsbury Madison & Sutro LLP

[57] ABSTRACT

A lamp current $i_L$ flows through a first resistor. Electric current I, which is the output current of a voltage-current converter which converts a lamp voltage $V_L$ to a lamp current I, flows through a second resistor. Feedback control is executed to make $V_-$, which is the voltage of one terminal of the second resistor, equal a reference voltage $V_{ref}$. The power applied to the lamp during start-up is controlled to be the same as the power applied to the lamp during its stable lighting for a predetermined lamp voltage range. Using the following two linear equations, the electric current I is set as $I=aV_L+b$ (where a and b are positive constants) when the lamp voltage $V_L$ is lower than a first predetermined voltage $V_a$ which is less than the lamp voltage during the normal stable lighting period of the lamp, and as $I=cV_L+d$ (where c and d are positive constants with $c<a$ and $d>b$), when the lamp voltage $V_L$ is greater than or equal to the first predetermined value $V_a$.

22 Claims, 6 Drawing Sheets

LAMP CONTROL CIRCUIT HAVING A V-I CONVERTER WITH SLOPES OF DIFFERENT MAGNITUDES AND A SECOND RESISTOR CONNECTED IN SERIES WITH A FIRST SUCH THAT THE SECOND SENSES THE OUTPUT CURRENT OF THE V-I CONVERTER

CROSS-REFERENCE TO RELATED APPLICATION

This application is related to and claims priority from Japanese Patent Application No. Hei-6-303771, the contents of which are hereby incorporated by reference.

BACKGROUND OF THE INVENTION

1. Field of the Invention

The present invention relates to a discharge lamp lighting device. More specifically, the present invention relates to a lighting device for high-voltage discharge lamps such as metal halide lamps and the like.

2. Description of Related Art

In general, high-voltage discharge lamps such as metal halide lamps do not generate light immediately after being lit because the vapor pressure of light emitting metals does not increase immediately.

Thus, to speed up the generation of light, Japanese Patent Laid-Open Publication No. Hei-5-144577 discloses a method for applying a start-up electric power to a discharge lamp which is greater than the prescribed electric power of the discharge lamp.

However, with such conventional technology described above, because the voltage applied to the lamp is controlled to be bigger when the lamp voltage is low, then the amount of lamp current becomes excessive and thus, the electrodes of the discharge lamp are consumed easily and the lifetime of the discharge lamp becomes shorter.

For this purpose, one plausible way of curbing electrode consumption might be to control the lamp current during start-up to equal the electric current during stable lighting. However, with this method, the arc discharge becomes unstable between electrodes during start-up, the inconvenience of the discharge lamp flickering out is likely to happen and such problems as the slowing down of the generation of the light output occur.

SUMMARY OF THE INVENTION

It is an object of the present invention to provide a device which solves the above-described problems.

It is a further object of the present invention to provide a device which offers the three advantages of: rapidly increasing the light output of the discharge lamp, preventing the interruption of the electric discharge of the discharge lamp after start-up and reducing the consumption of the electrode of the discharge lamp.

A yet further object of the present invention is to provide a device which realizes the above-described three advantages by controlling the electric current applied to the lamp during start-up to be greater than the lamp current during the stable lighting of the lamp, together with controlling the voltage applied to the lamp during start-up to be the same as the voltage applied to the lamp during its stable lighting.

Another object of the present invention is to provide a circuit which implements the three advantages described above.

To achieve these objectives, a first aspect of the present invention provides a discharge lamp lighting device which includes a discharge lamp, an electric power supply unit for supplying electric power to the discharge lamp, a first resistor through which a lamp current $i_L$ of the discharge lamp passes, an electric voltage-electric current converter for converting a lamp voltage $V_L$ of the discharge lamp to an output current I, and a second resistor through which the output current I of the voltage-current converter passes, which is connected in series with the first resistor, and which controls lamp power applied to the discharge lamp through feedback control which makes a voltage $V_-$ at a terminal of the second resistor at a side opposite that of the first resistor equal a reference voltage $V_{ref}$. The lamp power applied during start-up is no greater than a lamp power level during a normal lamp stable lighting period and, at a predetermined lamp voltage range, is controlled to be in the same level as that of the lamp power level during a stable lighting period. The current I of the voltage-current converter is determined using the following two linear equations: $I=aV_L+b$ (in which a and b are positive constants), when the lamp voltage $V_L$ is lower than a first predetermined voltage $V_a$ which is less than the lamp voltage during the normal stable lighting period of the lamp; and $I=cV_L+d$ (in which c and d are positive constants with $c<a$ and $d>b$), when the lamp voltage $V_L$ is no less than the first predetermined value $V_a$.

Thus, in this aspect of the present invention, the first and second resistors are connected in series, the lamp current $i_L$ passes through the first resistor, the current I flows through the second resistor and the voltage $V_-$ of one terminal of the second resistor (the terminal which is not connected to the first resistor) is maintained at the reference voltage $V_{ref}$. Therefore, if the resistance value of the first resistor is set as $R_1$ and the resistance value of the second resistor is set as $R_2$, then it is possible to establish the following relation.

$$V_-=V_{ref}=R_1\times i_L+R_2\times I$$

Also, the current I is set as $I=aV_L+b$ when the lamp voltage $V_L$ is lower than a first predetermined voltage $V_a$ which is less than the lamp voltage during the normal stable lighting period of the lamp; and as $I=cV_L+d$, when the lamp voltage $V_L$ is no less than the first predetermined value $V_a$. It must be noted here that it is a well-known fact that lamp voltage $V_L$ during start-up is lower than the lamp voltage during the ensuing stable lighting period.

Also, according to this aspect of the present invention, the electric power applied to the lamp during start-up is no greater than the electric power applied to the lamp during its normal stable lighting and for a predetermined lamp voltage range, the electric power applied to the lamp is the same as the electric power applied to the lamp during its normal stable lighting.

In this way, when the power applied to the lamp during start-up is equal to the power applied to the lamp during its stable lighting, from the above equations which express I and $V_-$, lamp current $i_L$ becomes bigger than the lamp current during the stable lighting of the lamp.

Therefore, according to this aspect of the present invention, because the lamp current during start-up becomes bigger than the lamp current during the stable lighting of the lamp, the problem of flickering of the discharge lamp can be prevented together with increasing the light generation speed of the lamp and curbing electrode consumption.

Another aspect of the present invention provides a discharge lamp lighting device wherein voltage-current converter includes first and second converters for generating currents $I_1$ and $I_2$, respectively, in accordance with the lamp voltage $V_L$, and a current output unit for generating a fixed current $I_3$, wherein the current I is equal to $I_1+I_2+I_3$.

In this aspect of the present invention, the current-voltage converter includes first and second converters and a current output unit with the current I being determined as the sum of current $I_1$ which is the current of the first converter, $I_2$ which is the current of the second converter and $I_3$ which is the current of the current output unit.

A further aspect of the present invention provides a discharge lamp lighting device wherein the first converter generates current $I_1$ which is proportional to lamp voltage $V_L$ when lamp voltage $V_L$ is no greater than the first predetermined voltage $V_a$ and generates a constant current $I_1$ which is not related to lamp voltage $V_L$ when lamp voltage $V_L$ is greater than the first predetermined voltage $V_a$.

A yet further aspect of the present invention provides a discharge lamp lighting device wherein the second converter generates current $I_2$ which is proportional to the lamp voltage $V_L$ when the lamp voltage $V_L$ is no greater than a second predetermined voltage $V_b$ which is higher than the lamp voltage during the normal lamp stable lighting period and generates a constant current $I_2$ which is not related to the lamp voltage $V_L$ when the lamp voltage $V_L$ is greater than the second predetermined voltage $V_2$.

An additional aspect of the present invention provides a discharge lamp lighting device wherein a fixed current $I_3$ of the current output unit is greater than output currents $I_1$ and $I_2$ of the first and second converters.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PRESENTLY PREFERRED EXEMPLARY EMBODIMENTS

Preferred embodiments of the present invention are described hereinafter with reference to the accompanying drawings.

Figure 1:
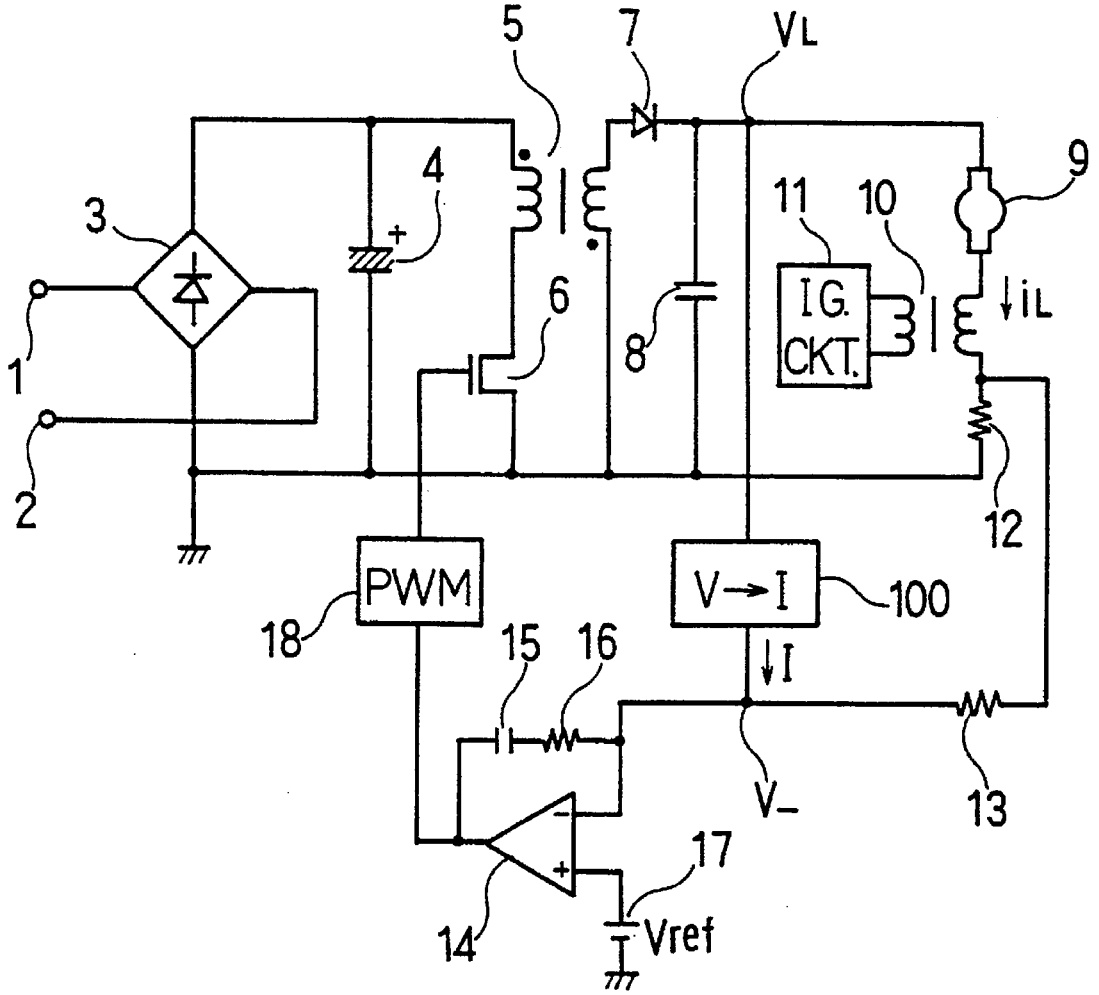
FIG. 1 is a block diagram of a discharge lamp lighting device according to a first embodiment of the present invention.

FIG. 1 shows a circuit construction of a discharge lamp lighting device according to a first embodiment of the present invention in which power input terminals 1, 2 are connected to a commercial electric power source, which is not shown, via switches. Electric power input terminals 1, 2 are connected to a diode bridge circuit 3 which converts alternating current to a direct current. The diode bridge circuit 3 is connected to a smoothing condenser 4 to smooth its full-wave rectified voltage. The smoothing condenser 4 is connected to a primary coil 5*a* of a transformer 5 and a series circuit of a semiconductor switching element 6.

A secondary coil 5*b* of the transformer 5 is connected to a rectifying diode 7 for rectifying the secondary voltage of the transformer 5 and a smoothing condenser 8 which smoothes the half-wave rectified voltage rectified by the rectifying diode 7. The smoothing condenser 8 is connected to a discharge lamp 9 such as a metal halide-type lamp. The discharge lamp 9 is connected to a secondary coil 10*b* of a high-voltage generating coil 10. The primary coil 10*a* of the high-voltage generating coil 10 is connected to an ignitor circuit 11 which generates a high voltage to the secondary coil 10*b* of the high-voltage generating coil 10. The discharge lamp 10 is connected to a first resistor 12 which detects a lamp current $i_L$.

The positive terminal side of the smoothing condenser 8 is connected to a voltage-current converter 100 which converts a lamp voltage $V_L$ of the discharge lamp 10 to a current I. The details of the construction of the voltage-current converter 100 are discussed later using FIG. 5.

An op-amp 14 is disposed at the output side of the voltage-current converter 100 with the inverting input terminal of the op-amp 14 connected to the output terminal of the voltage-current converter 100 and the non-inverting input terminal of the op-amp 14 connected to a reference voltage source 17 which generates a reference voltage $V_{ref}$. A second resistor 13 through which output current I of the voltage-current converter 100 flows through is disposed between a contact point of the inverting terminal of the op-amp 14 with the voltage-current converter 100 and the discharge side terminal of the first resistor 100. An alternating current feedback circuit which includes a series circuit of a condenser 15 and a resistor 16 is provided between the output and inverting input terminals of the op-amp 14.

A PWM (Pulse-Width Modulation) control circuit 18 is connected between the output terminal of the op-amp 14 and a control input terminal of the semiconductor switching element 6. The PWM control circuit 18 switches the semiconductor switching element 6 at a switching frequency of tens of kHz and controls the ON/OFF duty ratio of the semiconductor switching element 6 based on the output voltage of the op-amp 14.

Next, the operation of the discharge lamp lighting device which has been constructed as above is explained below.

When commercial electric power is supplied to electric power input terminals 1, 2, the commercial electric power is full-wave rectified by the diode bridge circuit 3, smoothed and converted to direct current power by the smoothing condenser 4 with the direct current power being applied to the primary coil 5*a* of the transformer 5 and the series circuit of the semiconductor switching element 6. At the same time, the PWM control circuit 18 is activated, the semiconductor switching element 6 performs switching operations and the current due to the direct current power flows intermittently to the primary coil 5*a* of the transformer 5.

An energy expressed as $L_1 \cdot I_1^2/2$ (where $L_1$ is the inductance of the primary coil 5*a* and $i_1$ is the value of the primary current of the semiconductor switching element 6 immediately before its disconnection), which is stored in the transformer 5 while the semiconductor switching element is connected, is released to the secondary coil 5*b* of the transformer 5 when the semiconductor switching element 6 is disconnected and thus, an alternating current voltage is generated in the secondary coil 5*b*. This alternating voltage is half-wave rectified by the rectifying diode 7 and stored in the smoothing condenser 8. Thus, if the stored voltage of the smoothing condenser 8 increases and reaches a predetermined voltage level, the ignition circuit 11 activates, a high voltage is generated in the secondary coil 10*b* of the high voltage generation coil and this high voltage is applied to the discharge lamp 9. With the application of this high voltage, there is breakdown between the electrodes of the smoothing condenser 9 as the insulation between them is destroyed and as a result, the stored electric load of the smoothing condenser 8 is released via the discharge lamp 9, electric power supply is continued to the discharge lamp 9 via transformer 5 due to a circuit operation that is explained later, and the discharge lamp 9 commences its lighting operations.

Figure 2:
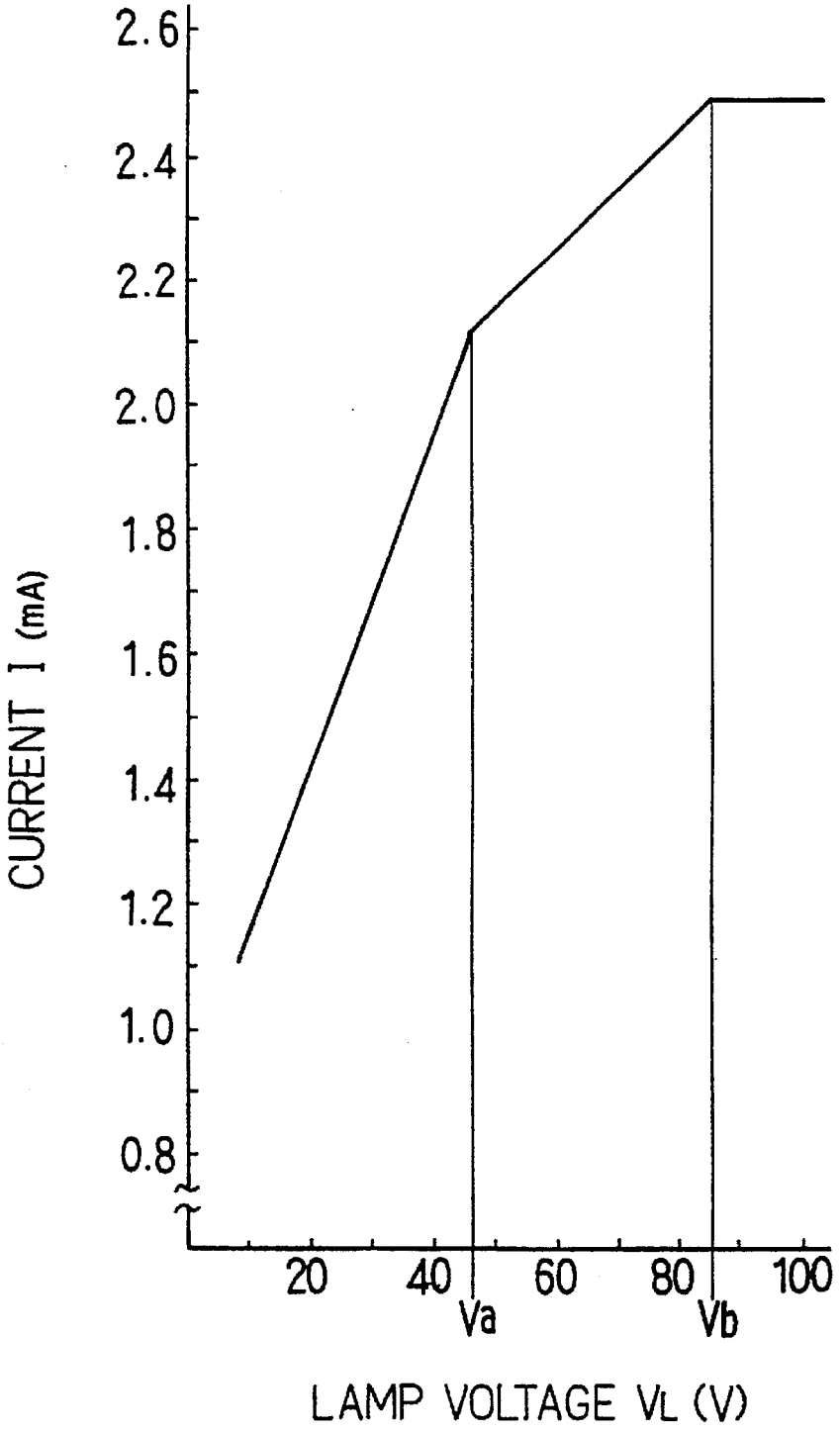
FIG. 2 is a characteristic curve of an output current I of a voltage-current converter.

When the discharge lamp 9 lights up, lamp current $i_L$ flows and due to the first resistor 12, this lamp current $i_L$ is detected as the voltage $i_L \cdot R_{12}$ ($R_{12}$ is the resistance of the first resistor 12) which appears at both ends of the first resistor 12. In addition, the voltage-current converter 100 generates current I, which is shown in FIG. 2, in accordance with the lamp voltage $V_L$ and this output current I flows to the second resistor 13 and the first resistor 12. Accordingly, while the input voltage $V_-$ to the inverting input terminal of the op-amp 14 becomes $V_-=i_L \cdot R_{12}+I \cdot (R_{13}+R_{12})$ (where $R_{13}$ is the resistance of the second resistor), because $I \ll i_L$, then $V_- \approx i_L \cdot R_{12}+I \cdot R_{13}$. On the other hand, the reference voltage $V_{ref}$ is applied to the non-inverting terminal of the op-amp 14. The operational amplifier 14 compares $V_-$ and $V_{ref}$ and amplifies and generates the voltage difference between them. The output voltage of the op-amp 14 is provided to the PWM control circuit 18 with the PWM control circuit 18 controlling the ON/OFF duty ratio of the semiconductor switching element 6 in accordance with the output voltage of the op-amp 14 and from this, the power applied to the discharge lamp is also controlled.

Due to this type of feedback control, the power applied to the discharge lamp 9 is controlled to a predetermined value in accordance with the lamp voltage $V_L$. In other words, feedback control is performed such that $V_-=V_{ref}$.

Next, the output current I of the voltage-current converter 100 is explained using FIG. 2.

FIG. 2 shows the characteristic curve when a xenon-metal halide lamp rated at 60 volts and 60 watts is used as the discharge lamp 9, the resistance of the first resistor 12 is 0.43 Ω, the resistance of the second resistor 13 is 704 Ω and the reference voltage $V_{ref}$ is 2 volts.

As shown in FIG. 2, the output current I is determined using the following three equations: $I=0.027 \times V_L+0.88$ mA when the lamp voltage $V_L$ is lower than a first predetermined voltage V which is no greater than the lamp voltage (60 V) of a normal lamp during stable lighting, $I=0.0092 \times V_L+1.67$ [mA] when the lamp voltage $V_L$ is no less than the first predetermined voltage $V_a$ and no greater than a second predetermined voltage $V_b$ which is greater than the lamp voltage (60 V) during the stable lighting of a normal lamp, and I=2.48 mA when the lamp voltage $V_L$ is greater than the second predetermined voltage $V_b$.

Figure 3:
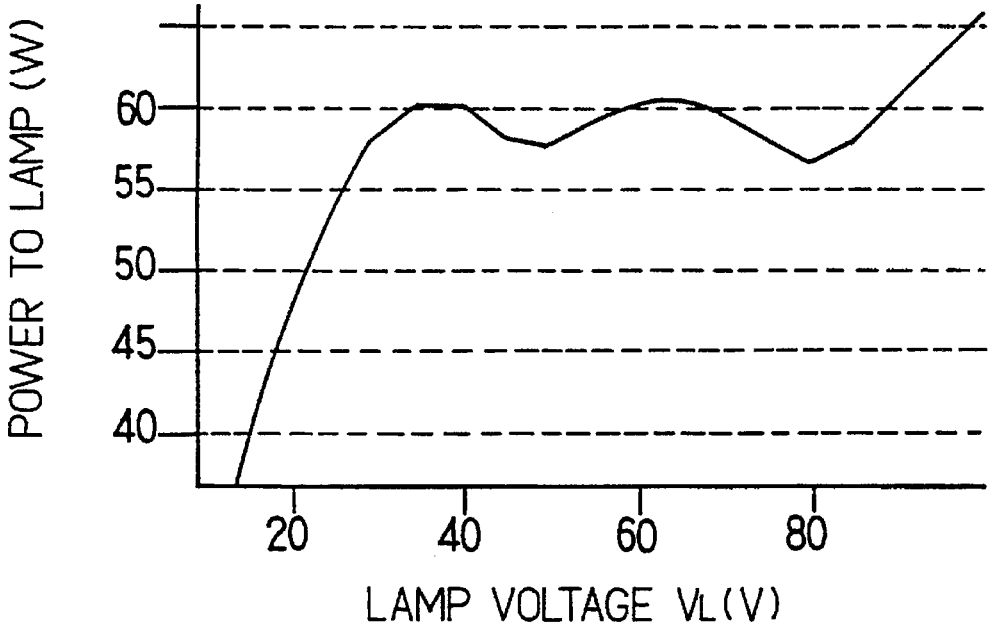
FIG. 3 is a characteristic curve of power applied to the lamp.
Figure 4:
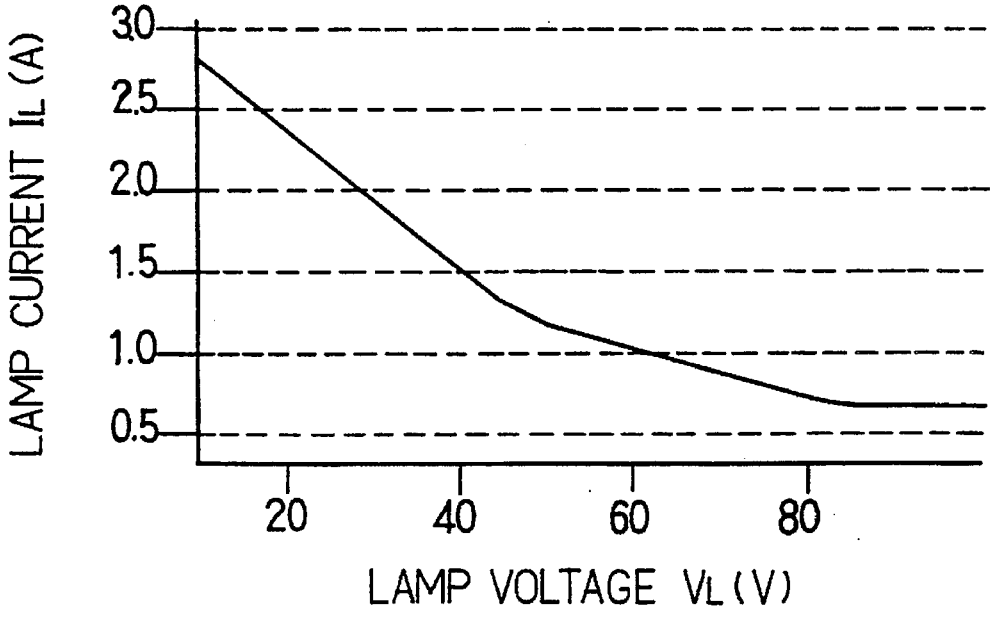
FIG. 4 is a characteristic curve of a lamp current $i_L$.

Then, if the output current is set as in the above, the relationship between the lamp voltage $V_L$ and the power applied to the lamp is shown in FIG. 3. As shown in FIG. 3, even for the case when the lamp voltage $V_L$ is less than the rated voltage of 60 V, the power applied to the lamp is kept at the level of the power that is applied during the stable lighting of the lamp. Also, the relationship between lamp voltage $V_L$ and lamp current $i_L$ is shown in FIG. 4. As shown in FIG. 4, when the lamp voltage $V_L$ is no greater than the rated voltage of 60 V, the current $i_L$ becomes greater than the current $i_L$ during the stable lighting of the lamp.

Figure 5:
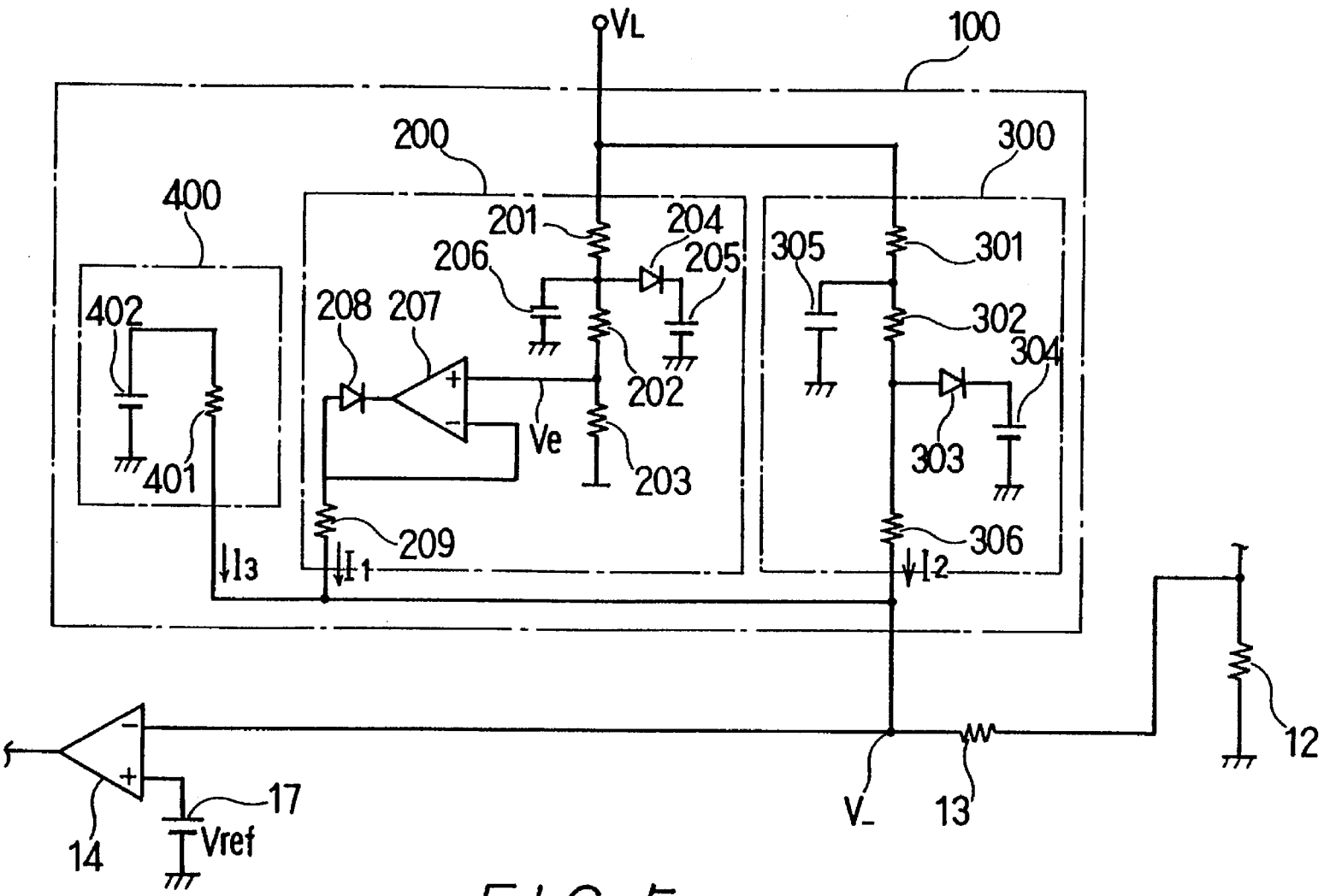
FIG. 5 is a block diagram of the voltage-current converter.

Such current I can be derived using the voltage-current converter 100 whose actual construction is shown in FIG. 5.

As shown in FIG. 5, the voltage-current converter 100 includes a first converter unit 200, a second converter unit 300 and a current output unit 400.

The first converter unit 200 includes three voltage dividing resistors 201, 202, 203 which divide the lamp voltage $V_L$. The contact point of first voltage dividing resistor 201 and the second voltage dividing resistor 202 is connected to the clamp diode 204 which clamps the lamp voltage $V_L$ to a predetermined voltage and the series circuit of the reference voltage generator 205 which generates the reference voltage that determines the clamp voltage. Here, the clamp diode 204 is provided to prevent the destruction of op-amp 207, which is explained later, due to a high voltage $V_L$ immediately before lamp current $i_L$ flows to discharge lamp 9 during start-up. Also, a smoothing condenser 206 for removing noise is connected to the above connection point. The connection point of the second voltage dividing resistor 202 and the third voltage dividing resistor 203 is connected to the clamp circuit which includes the op-amp 207 and the rectifying diode 208. The output terminal of the clamp circuit is connected to a resistor 209 which is connected to the output terminal of the voltage-current converter 100.

Figure 6:
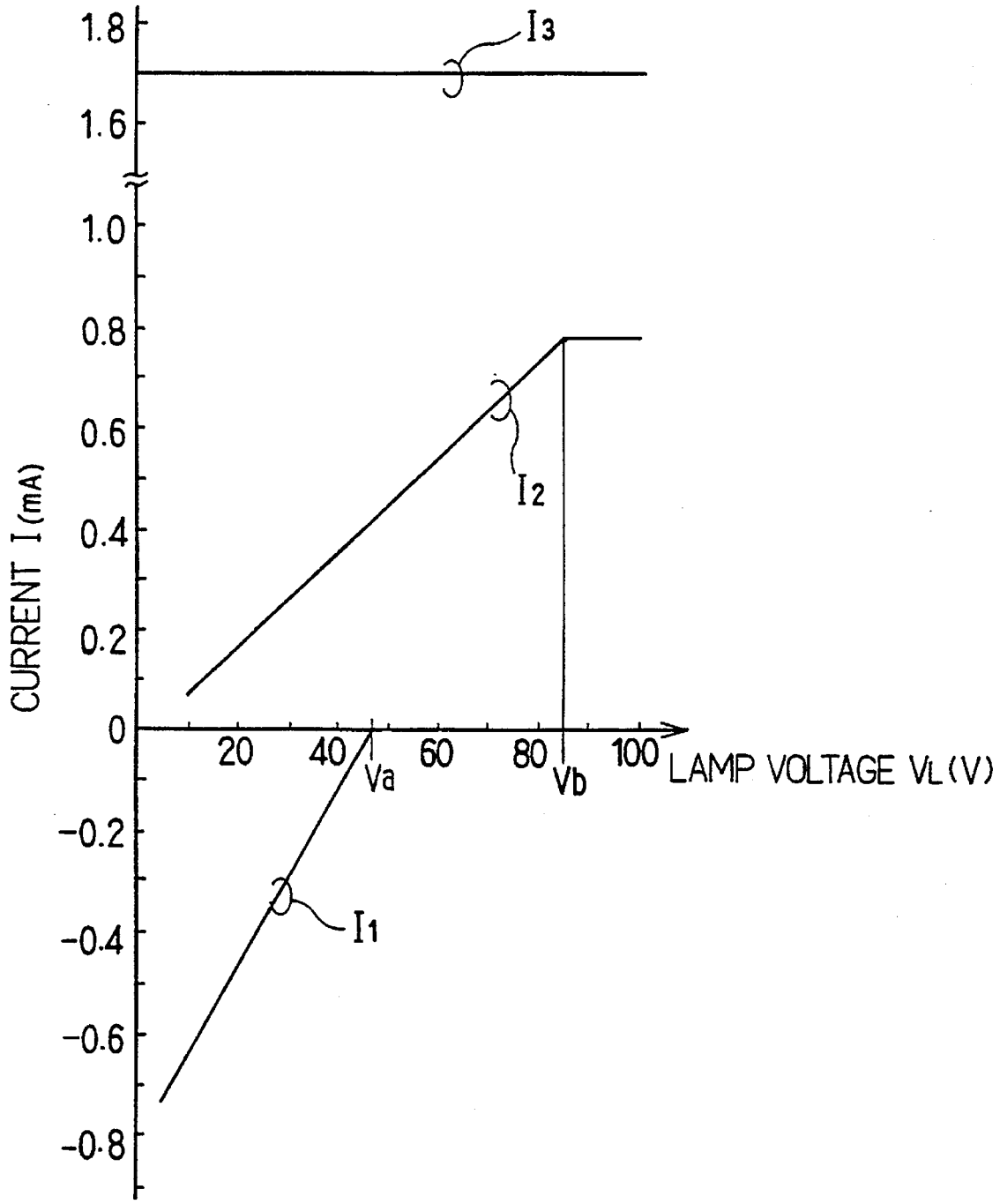
FIG. 6 is a characteristic curve of output currents $I_1$, $I_2$, $I_3$ of the first and second converters and the current output unit.

For the first converter unit 200 constructed in the above manner, the lamp voltage $V_L$ is partially divided by the first, second and third voltage dividing resistors 201, 202, 203 and the voltage $V_e$ of the contact point of the second voltage dividing resistor 202 with the third voltage dividing resistor 203 becomes a voltage which is proportional to the lamp voltage $V_L$. With op-amp 207, this voltage $V_e$ is controlled to be equal to the reference voltage $V_{ref}$ of the other op-amp 14. In this way, when $V_e$ is no greater than $V_{ref}$, the output current $I_1$ becomes $I_1=(V_e-V_{ref})/R_{209}$ amperes ($R_{209}$ is the resistance of resistor 209). Then, later on, the lamp voltage $V_L$ increases and when $V_e=V_{ref}$, current $I_1$ stops flowing because $V_e=V_-$. Then, when lamp voltage $V_L$ increases further that $V_e=V_{ref}$, current $I_1$ does not flow because of op-amp 207 and the clamping action of the rectifying diode 208. From the above operation, as shown in FIG. 6, the output current $I_1$ of the first converter unit 200 is proportional to the lamp voltage $V_L$ when the lamp voltage $V_L$ is no greater than the first predetermined voltage $V_a$ and is kept at 0 A when the lamp voltage $V_L$ is greater than the first predetermined voltage $V_a$. It must be noted here that the characteristic curve of FIG. 6 corresponds to the case when the resistances of the first, second and third voltage dividing resistors 201, 202 and 203 have been set so that $V_e=V_{ref}$ when lamp voltage $V_L$ is equal to the first predetermined voltage $V_a$.

The second converter unit 300, which is connected between the input and output terminals of the voltage-current converter 100, includes a series circuit of three resistors 301, 304 and 306. The contact point of the first resistor 301 with the second resistor 303 is connected to the smoothing condenser 305 which absorbs noise. The contact point of the second resistor 302 with the third resistor 306 is connected to a clamp diode 303 which clamps lamp voltage $V_L$ to a predetermined voltage and the series circuit of the reference voltage source 304 which generates the reference voltage that determines the clamp voltage.

For the second converter unit 300 constructed like this, when the lamp voltage $V_L$ does not reach the voltage value of the clamp voltage which is determined by the reference voltage of the reference voltage source 304, the output current $I_2$ of the second converter unit 300 becomes $I_2=$ $(V_L-V_{ref})/(R_{301}+R_{302}+R_{306})$ amperes (where $R_{301}$ is the resistance of the first resistor 301, $R_{302}$ is the resistance of the second resistor 302 and $R_{306}$ is the resistance of the third resistor 306). When the lamp voltage $V_L$ increases and becomes no less than the clamp voltage, clamp diode 303 conducts and output current $I_2$ becomes $I_2=(V_{304}+V_F-V_{ref})/R_{306}$ amperes (where $V_{304}$ is the reference voltage of the reference voltage source 304 and $V_F$ is the forward voltage drop of the clamp diode 303). Based on the above operations, as shown in FIG. 6 which is the characteristic curve of the output current $I_2$ of the second converter unit 300, the output current $I_2$ has a value that is proportional to the lamp voltage $V_L$ when the lamp voltage $V_L$ is no greater than the second predetermined voltage $V_b$ and is kept at a predetermined value when lamp voltage $V_L$ is greater than the second predetermined voltage $V_b$. It must be noted here that the characteristic curve shown in FIG. 6 corresponds to the case when $V_{304}$, $R_{301}$, $R_{302}$ and $R_{306}$ are set so that when the lamp voltage $V_L$ becomes the second predetermined voltage $V_b$, $V_e=V_{ref}$.

The current output unit 400 includes a reference voltage source 402 which generates a reference voltage and a resistor 401 which is connected between the reference voltage source 402 and the output terminal of the voltage-current converter 100.

For the current output unit 400 constructed as above, the output current $I_3$ becomes $I_3=(V_{402}-V_{ref})/R_{401}$ (where $V_{402}$ is the reference voltage of the reference voltage source 402 and $R_{401}$ is the resistance of resistor 401). Therefore, as shown in FIG. 6, the output current $I_3$ of the current output unit 400 is kept at a predetermined value.

Therefore, the output current $I_1$ of the first converter unit 200, the output current $I_2$ of the second converter unit 2300 and the output current $I_3$ of the current output unit 400 will be as shown in FIG. 6 and thus, the output current I $(=I_1+I_2+I_3)$ of the voltage-current converter 100 will be like the one shown in FIG. 2.

As explained in the above, in the discharge lamp lighting device of the present embodiment, the first resistor 12 and the second resistor 13 are connected in series, the lamp current $i_L$ flows through the first resistor 12, current I flows through the second resistor 13 and the voltage $V_-$ of one terminal of the second resistor 13 (the terminal which is not connected to the first resistor 12) is kept at the reference voltage $V_{ref}$. Also, the following equation holds: $V_-=V_{ref}\approx R_{12}\times i_L+R_{13}\times I$. The current I is determined following these two equations which express a continuous line: $I=0.027\times V_L+0.88$ mA when the lamp voltage $V_L$ is no greater than the first predetermined voltage $V_a$ which is lower than the lamp voltage during the normal stable lighting of the lamp, and $I=0.0092\times V_L+1.67$ mA when the lamp voltage $V_L$ is greater than the first predetermined voltage $V_a$. Furthermore, the power applied to the lamp during start-up is no greater than the power applied to the lamp during its normal stable lighting and for a predetermined lamp voltage range, the power applied to the lamp is controlled to be equal to such power applied to the lamp during its normal stable lighting. In this way, during start-up, when the power applied to the lamp is about the same as the power applied to the lamp during its normal stable lighting, lamp current $I_L$ becomes greater than the lamp current during the stable lighting of the lamp. Therefore, according to the discharge lamp lighting device described above, because the lamp current during start-up becomes bigger than the lamp current during the stable lighting of the lamp and the power applied to the lamp during start-up is no greater than the power applied to the lamp during its stable lighting, the flickering out of the discharge lamp is prevented together with generating the light output at high speed and reducing the consumption of the electrode of the discharge lamp.

Also, because electric current I is set at a predetermined value of 2.48 mA when the lamp voltage $V_L$ is no less than a second predetermined voltage $V_b$, the non-illumination of the discharge lamp is shortened and the end of life of the discharge lamp can be known quickly by increasing the end of life power applied to the lamp.

Figure 7:
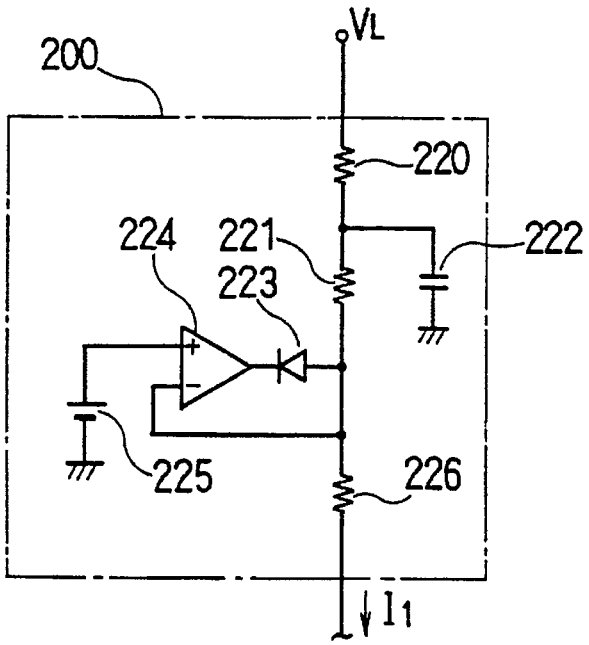
FIG. 7 is a block diagram of a first converter according to another embodiment of the present invention.

FIG. 7 shows the construction of the first converter unit 200 according to a second embodiment of the present invention.

Figure 8:
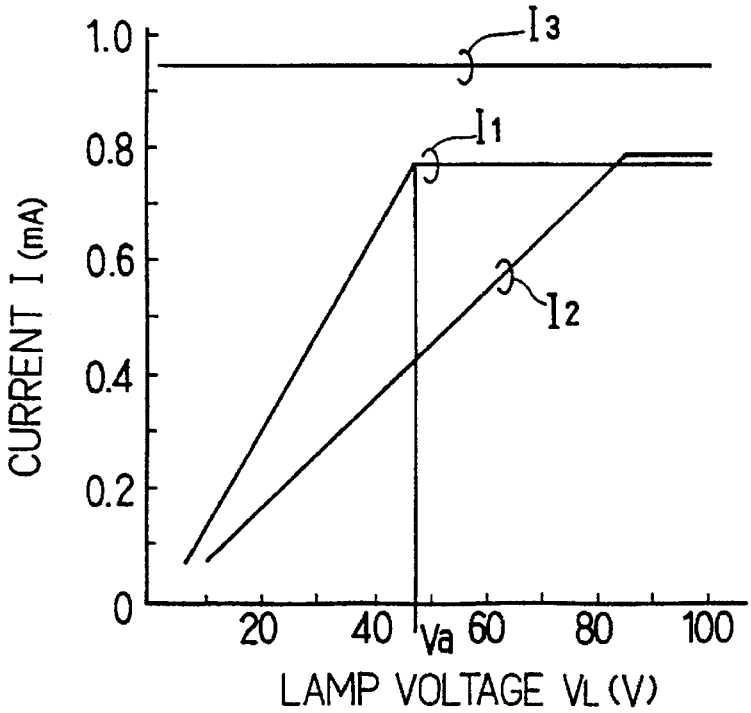
FIG. 8 is a characteristics curve of output currents $I_1$, $I_2$, $I_3$ of the first and second converters and the current output unit.

As shown in FIG. 7, when the lamp voltage $V_L$ is no greater than a first predetermined voltage $V_a$, the voltage of the anode terminal of the clamp diode 223 becomes lower than the reference voltage $V_{225}$ of the reference voltage source 225, the clamp diode 223 is kept in a disconnected state and the Output current $I_1$ becomes $I_1=(V_L-V_{ref})/(R_{220}+R_{221}+R_{226})$ amperes (where $R_{220}$ is the resistance of resistor 220, $R_{221}$ is the resistance of resistor 221 and $R_{226}$ is the resistance of resistor 226). In addition, when the lamp voltage $V_L$ is greater than or equal to the first predetermined voltage $V_a$, because of the clamp circuit which includes clamp diode 223, op-amp 224 and reference voltage source 225, the voltage of the anode terminal of the clamp diode 223 is kept at the reference voltage $V_{225}$ of the reference voltage source 225 and output current $I_1$ becomes $I_1=(V_{225}-V_{ref})/R_{226}$. In this way, the characteristic curve of the output current $I_1$ is as shown in FIG. 8. FIG. 8 shows that the electric current $I_2$ is the same as the electric current $I_2$ for FIG. 6 and that the electric current $I_3$ is different from the electric current $I_3$ of FIG. 6. FIG. 8 shows the values of the electric currents when the resistance of resistor 401 is changed. Also, electric current I which is the sum of electric currents $I_1$, $I_2$ and $I_3$ is made to have the same characteristics as that of electric current I of FIG. 2. It must be noted here that the numeral 222 in FIG. 7 refers to a smoothing condenser which absorbs noise.

Although the present invention has been fully described in connection with preferred embodiments thereof with reference to the accompanying drawings, it is to be noted that various changes and modifications will be apparent to those skilled in the art. For example, while the present embodiment has been applied to home-use lighting devices which use commercial electric power, the present invention can also be used for vehicular lighting device which use power from a vehicular direct current power supply. Such changes and modifications are to be understood as being within the scope of the present invention as defined in the appended claims.

What is claimed is:

1. A discharge lamp lighting device comprising:

a discharge lamp;

electric power supply means for supplying power to said discharge lamp;

a first resistor through which a lamp current $i_L$ of said discharge lamp passes;

a voltage-current converter for converting a lamp voltage $V_L$ of said discharge lamp to an output current I; and a second resistor through which said output current I of said voltage-current converter passes, said second resistor being connected in series with said first resistor, said discharge lamp lighting device being for controlling lamp power applied to said discharge lamp through feedback control which makes a voltage $V_-$ at a terminal of said second resistor at a side opposite said first resistor equal a reference voltage $V_{ref}$, wherein lamp power applied during start-up is no greater than lamp power level during a normal lamp stable lighting period and, at a predetermined lamp voltage range, is controlled to be at a same level as that of said lamp power level during a stable lighting period; and wherein said current I of said voltage-current converter is determined using the following two linear equations:

$I=aV_L+b$ (where a and b are positive constants), when the lamp voltage $V_L$ is lower than a first predetermined voltage $V_a$ which is less than a lamp voltage during a normal stable lighting period of the lamp; and $I=cV_L+d$ (where c and d are positive constant with $c<a$ and $d>b$), when the lamp voltage $V_L$ is no less than a first predetermined voltage $V_a$.

2. A discharge lamp lighting device according to claim 1, wherein said voltage-current converter includes:

first and second converters for generating currents $I_1$ and $I_2$, respectively, in accordance with the lamp voltage $V_L$; and a current output unit for generating a fixed current $I_3$, and wherein said current I is equal to $I_1+I_2+I_3$.

3. A discharge lamp lighting device according to claim 2, wherein said first converter is for generating said current $I_1$ which is proportional to said lamp voltage $V_L$ when said lamp voltage $V_L$ is no greater than said first predetermined voltage $V_a$ and generates a constant current $I_1$ independent of said lamp voltage $V_L$ when said lamp voltage $V_L$ is greater than said first predetermined voltage $V_a$.

4. A discharge lamp lighting device according to claim 3, wherein said second converter is for generating said current $I_2$ which is proportional to said lamp voltage $V_L$ when said lamp voltage $V_L$ is no greater than a second predetermined voltage $V_b$ which is higher than the lamp voltage during a normal lamp stable lighting period and generates a constant current $I_2$ independent of said lamp voltage $V_L$ when said lamp voltage $V_L$ is greater than said second predetermined voltage $V_b$.

5. A discharge lamp lighting device according to claim 4, wherein said fixed current $I_3$ of said current output unit is greater than output currents $I_1$ and $I_2$ of said first and second converters, respectively.

6. A discharge lamp lighting device according to claim 3, wherein said fixed current $I_3$ of said current output unit is greater than output currents $I_1$ and $I_2$ of said first and second converters, respectively.

7. A discharge lamp lighting device according to claim 2, wherein said second converter is for generating said current $I_2$ which is proportional to said lamp voltage $V_L$ when said lamp voltage $V_L$ is no greater than a second predetermined voltage $V_b$ which is higher than the lamp voltage during a normal lamp stable lighting period and generates a constant current $I_2$ independent of said lamp voltage $V_L$ when said lamp voltage $V_L$ is greater than said second predetermined voltage $V_b$.

8. A discharge lamp lighting device according to claim 2, wherein said fixed current $I_3$ of said current output unit is greater than output currents $I_1$ and $I_2$ of said first and second converters, respectively.

9. An electric power control circuit of a discharge lamp lighting device for adjusting power applied to a discharge lamp, said power control circuit comprising:

a voltage-current converter for generating an output current in correspondence with a lamp voltage $V_L$ applied to the lamp and which has a predetermined conversion characteristic for converting lamp voltage to output current, wherein said conversion characteristic is set as a slope of the change in the current with the change in the lamp voltage where a slope at low lamp voltages is set higher than a slope at high lamp voltages;

an electric power signal generation circuit for generating an output voltage signal V_ in accordance with the output current of the voltage-current converter and current which flows to the discharge lamp; and a control circuit for comparing the output voltage signal of said electric power signal generation circuit and a predetermined reference voltage and which generates a control signal for adjusting the electric power applied to said discharge lamp to make said voltages equal.

10. An electric power control circuit according to claim 9, wherein:

the voltage-current converter is for increasing the output current in accordance with the increase in the lamp voltage $V_L$ using a first proportional constant a when the lamp voltage $V_L$ is in a predetermined low voltage range ($<V_a$) and increases the output current in accordance with the increase in the lamp voltage using a second proportional constant c when the lamp voltage $V_L$ is in a predetermined central voltage range ($V_a \leqq V_L < V_b$);

said low voltage range is lower than the lamp voltage during a stable lighting of the discharge lamp; and said first proportional constant a is greater than said second proportional constant c.

11. An electric power control circuit according to claim 10, wherein:

said voltage-current converter is for keeping the output current constant when the lamp voltage $V_L$ is in a predetermined high voltage range ($\geqq V_b$).

12. An electric power control circuit according to claim 11, said power control circuit further comprising:

an electric power adjustment circuit for adjusting electric power applied to the discharge lamp in response to the control signal from said control circuit.

13. An electric power control circuit according to claim 12, said electric power adjustment circuit comprising:

a transformer whose output from a secondary side is supplied to the discharge lamp;

a semiconductor switching element for selectively controlling direct current power supplied to a primary side of the transformer; and a PWM circuit for varying a ratio between on-time and off-time of said semiconductor switching element in response to said control signal.

14. A discharge lamp lighting device for lighting a discharge lamp, said discharge lamp lighting device comprising:

an electric power adjustment circuit for adjusting power supplied to the discharge lamp in accordance with a control signal;

a first resistor connected in series with the discharge lamp;

a voltage-current converter for generating an output current in correspondence with a lamp voltage $V_L$ applied to the lamp and which has a predetermined conversion characteristic for converting lamp voltage to output current, wherein said conversion characteristic is set as a slope of the change in the current with the change in the lamp voltage where a slope at low lamp voltages is set higher than a slope at high lamp voltages;

a second resistor for providing said output current generated by said voltage-current converter to said first resistor; and a control circuit for generating a control signal to the electric power adjustment circuit to make a voltage drop between said first resistor and said second resistor constant.

15. A discharge lamp lighting device according to claim 14, said voltage-current converter being for increasing the output current in accordance with the increase in the lamp voltage $V_L$ using a first proportional constant a when the lamp voltage $V_L$ is in a predetermined low voltage range ($<V_a$) and increasing the output current in accordance with the increase in the lamp voltage using a second proportional constant c when the lamp voltage $V_L$ is in a predetermined central voltage range ($V_a \leqq V_L < V_b$), wherein said low voltage range is set to be lower than the lamp voltage during a stable lighting of the discharge lamp; and wherein said first proportional constant a is set to be greater than said second proportional constant c.

16. A discharge lamp lighting device according to claim 15, wherein said electric voltage-electric current converter is for keeping the output current constant when the lamp voltage $V_L$ is in a predetermined high voltage range ($\geqq V_b$).

17. A discharge lamp lighting device according to claim 16, said electric power adjustment circuit comprising:

a transformer whose output from a secondary side is supplied to the discharge lamp;

a semiconductor switching element for selectively controlling the direct current power supplied to a primary side of the transformer; and a PWM circuit for varying a ratio between on-time and off-time of said semiconductor switching element in response to said control signal.

18. An electric power control circuit according to claim 9, wherein said conversion characteristic is set as a slope of the change in the current with the change in the lamp voltage where a slope at low lamp voltages is set higher than a slope at high lamp voltages and the power applied to the lamp is kept at the level of power that is applied during stable lighting of the lamp.

19. An electric power control circuit according to claim 18, wherein:

the voltage-current converter is for increasing the output current in accordance with the increase in the lamp voltage $V_L$ using a first proportional constant a when the lamp voltage $V_L$ is in a predetermined low voltage range ($<V_a$) and increases the output current in accordance with the increase in the lamp voltage using a second proportional constant c when the lamp voltage $V_L$ is in a predetermined central voltage range ($V_a \leqq V_L < V_b$);

said low voltage range is lower than the lamp voltage during a stable lighting of the discharge lamp; and said first proportional constant a is greater than said second proportional constant c.

20. An electric power control circuit according to claim 19, wherein:

said voltage-current converter is for keeping the output current constant when the lamp voltage $V_L$ is in a predetermined high voltage range ($\geqq V_b$).

21. An electric power control circuit according to claim 20, said power control circuit further comprising:

an electric power adjustment circuit for adjusting electric power applied to the discharge lamp in response to the control signal from said control circuit.

22. An electric power control circuit according to claim 21, said electric power adjustment circuit comprising:

a transformer whose output from a secondary side is supplied to the discharge lamp;

a semiconductor switching element for selectively controlling direct current power supplied to a primary side of the transformer; and a PWM circuit for varying a ratio between on-time and off-time of said semiconductor switching element in response to said control signal.

* * * * *